US008789714B1

(12) United States Patent
Kruger et al.

(10) Patent No.: US 8,789,714 B1
(45) Date of Patent: Jul. 29, 2014

(54) SEPTIC TANK HAVING DEFORMATION-RESISTING TOP ACCESS FLANGE

(75) Inventors: Kurt J. Kruger, Hamden, CT (US); Roy E Moore, Jr., Killingworth, CT (US); Bryan J. Coppes, Old Saybrook, CT (US)

(73) Assignee: Infiltrator Systems Inc, Old Saybrook, CT (US)

( * ) Notice: Subject to any disclaimer, the term of this patent is extended or adjusted under 35 U.S.C. 154(b) by 53 days.

(21) Appl. No.: 12/872,387

(22) Filed: Aug. 31, 2010

Related U.S. Application Data

(60) Provisional application No. 61/308,293, filed on Feb. 25, 2010.

(51) Int. Cl.
*B65D 6/00* (2006.01)
*B65D 8/00* (2006.01)

(52) U.S. Cl.
USPC ..... 220/4.13; 210/532.2

(58) Field of Classification Search
USPC ..... 220/601, 4.13, 565, 567.1; 210/532.2, 210/170.08
See application file for complete search history.

(56) References Cited

U.S. PATENT DOCUMENTS 5,308,423 A * 5/1994 Kauffman ..... 220/567.1
6,280,614 B1 * 8/2001 Berg et al. ..... 210/170.08
7,144,506 B2 * 12/2006 Lombardi, II ..... 210/532.2
7,178,686 B2 * 2/2007 Bolzer et al. ..... 220/567.1
7,770,333 B2 * 8/2010 Meyers ..... 220/4.03
8,070,005 B1 12/2011 Kruger
8,151,999 B1 * 4/2012 Moore et al. ..... 210/532.2
2001/0019026 A1 * 9/2001 Berg et al. ..... 210/532.2
2006/0081629 A1 4/2006 Meyers
2006/0289546 A1 * 12/2006 Carter ..... 220/565

OTHER PUBLICATIONS

Neilsen, L.W & Landel, R. F Mechanical Properties of Polymers and Composites, (1994) pp. 479-483 Marcel Dekker, Inc, New York, USA.

Infiltrator-Systems Inc "EZ Set by Infiltrator" Brochure (2009) With Press Release; 3 Pages.

Focus Industries, Inc. Tank Lids, Bulkheads and Accessories; 6 Page Brochure (2010).

* cited by examiner

*Primary Examiner* — Andrew Perreault
(74) *Attorney, Agent, or Firm* — C. Nessler

(57) ABSTRACT

A plastic septic tank has a body made by rotational molding or blow molding and at least one access opening in the top. A ring flange is structurally attached to the top of the body so the bore of the flange fits the access opening. A plastic ring flange has a flexural modulus which is greater than 100,000 psi and at least twice the flexural modulus of the plastic material of the tank body. An exemplary flange is made of a plastic material which includes 5-30 weight percent glass fibers, a significant portion of which are aligned with the plane of the flange upper surface.

8 Claims, 5 Drawing Sheets

SEPTIC TANK HAVING DEFORMATION-RESISTING TOP ACCESS FLANGE

This application claims benefit of U.S. provisional patent application 61/308,293 filed on Feb. 25, 2010.

TECHNICAL FIELD

The present invention relates to molded plastic tanks, in particular to large blow molded or rotationally molded tanks which are useful as septic tanks for processing wastewater when buried in soil.

BACKGROUND

Large plastic tanks, such as tanks of about 350 to 1250 gallons or more in nominal volume, have been widely used as septic tanks for treating wastewater, and also for storing water and other liquids. Typically, such large tanks are made by one of three processes: (1) laying up fiberglass fibers or mats in molds and bonding them together with a thermoset resin, such as polyester resin; (2) blow molding, in which a parison or mass of molten thermoplastic is positioned within a mold and forced by gas to expand outwardly against the walls of the mold cavity; and (3) rotational molding, in which a heated mold is rotated simultaneously on two or three axes while powdered thermoplastic is deposited into the mold, so that the plastic melts and adheres to the mold walls.

It is common for plastic septic tanks to have generally rectangular or round cross sections and to be buried so the length is horizontal. Such tanks require access openings at the top. Typically there are two spaced-apart circular openings of 1-2 feet in diameter, which are fitted with removable lids. The access openings permit placement of fittings and baffles within the tank at the time of installation. They also enable maintenance of the tank during use. For instance, exit end filters need to be cleaned and accumulated undigestible debris (commonly called sludge) must be periodically removed from the bottom of the tank.

The tanks must resist stresses which result from handling, storage and installation, in particular during backfilling of the hole in the earth into which a tank is placed. During use, tanks must resist the weight of overlying soil and possible vehicles crossing the soil surface, as well as the inward pressure of the soil and surrounding water, particularly when the tank is emptied for maintenance.

It is always an aim to minimize the weight of material needed to make a tank. The relationship between length and cross section is mostly such as to efficiently use plastic material. And the tanks, which commonly have walls of one-quarter to three-eights of an inch in thickness, are typically heavily corrugated to increase section modulus. Still, there is some tendency for thermoplastic tanks to deform or distort in vicinity of the top access openings, to the point that the lids or risers which attach to the tank will not properly fit the tank opening, either upon initial installation of the tank, or when covers are reinstalled after maintenance. Despite the past efforts of designers, the top of a molded tank may distort to the extent that a typical circular access opening becomes oblong (usually because of inward thrust of the lengthwise walls), or because the desired flat upper surface of the tank at the opening becomes twisted. When that occurs, the lid or other component mounted on the flange can have a poor fit, and in a worse case, soil and the like can fall into the tank. There also may be a failure to meet regulatory requirements related to joint leakage.

In fiberglass tanks, localized distortion of a tank can be countered by design changes involving preferential fiber orientation, or extra plies of fiberglass mat material. However, in the blow molded and rotationally molded thermoplastic tanks, the material properties of the typical HDPE polyethylene or other polyolefin material are substantially the same in all directions and it is not possible to vary them selectively at high stress locations. And neither blow molding nor rotational molding readily admit achieving localized regions of greatly increased thickness. Welding or otherwise affixing structure inside or outside the tank, to help the tank resist distortion, can be costly. Thus, there is a need for improved construction of tanks which enables provides better resistance to deformation in vicinity of access openings.

SUMMARY

An object of the invention is to provide a tank for use in handling wastewater and other purposes, where the tank has a top access opening, and where the tank has strength to resist deformation of the area around the opening during storage or use; and where there is a means for attaching lids, risers or the like at the point of opening.

In accord with the invention, a plastic septic tank has a body with one or more top access openings. Associated with at least one such opening is a separately formed and structurally attached flange made of plastic material. Such flange is typically circular and has a bore which aligns with the access opening in the tank body, to provide a passageway to the tank interior. Typically, the flange is adapted to receive a lid or riser. The flange may be structurally attached to the tank by fasteners, adhesives, welding, or other means.

In an embodiment of the invention, the flexural modulus of the plastic material of the flange is at least 100 percent, preferably 200 percent greater than the flexural modulus of the plastic material of the tank body; and the flexural modulus of the flange material is at least 100,000 psi, preferably at least 200,000 psi. In further accord with an embodiment of the invention, the flange material is a thermoplastic material which comprises 5 to 30 percent by weight of chopped fiberglass fibers; and a significant portion of the fibers is aligned with a plane that is nominally parallel to the flange top surface and the top of the body of the tank. A thermoplastic tank body may be formed by blow molding or rotational molding. A rotationally molded tank body may have a multi-layer construction. The base compositions of the plastic material of the tank and flange may be the same or different. Representative base materials of the flange and tank body are selected from polyethylene or polypropylene.

In accord with embodiments of the invention, a flange is made of a plastic material which has a flexural modulus which is at least 100 percent greater, and more preferably about 200-300 percent greater, than the flexural modulus of the material of the tank body. The flange may be of the same material as the tank, but with addition of strengthening substance, such as chopped fibers of glass or other material. When the flange and tank body are of the same thermoplastic material, for instance, when they are both polyethylene, the flange may be welded to the tank to achieve both the structural and water-seal connection. Alternately, the flange may be made of a different plastic material, including a thermoset material.

In further accord with embodiments of the invention, the fibers included in plastic of the flange plastic are in significant portion oriented so that they are generally parallel to the plane of the upper surface of the flange; and furthermore, the fibers may in significant portion be oriented so that they run circumferentially, that is, so they are aligned with local tangents to the periphery of the flange. In another aspect of the invention, the flange is a composite material, such as polyester resin reinforced with fiberglass mats.

The foregoing and other objects, features and advantages of the present invention will become more apparent from the following description of preferred embodiments and accompanying drawings.

DESCRIPTION

Figure 1:
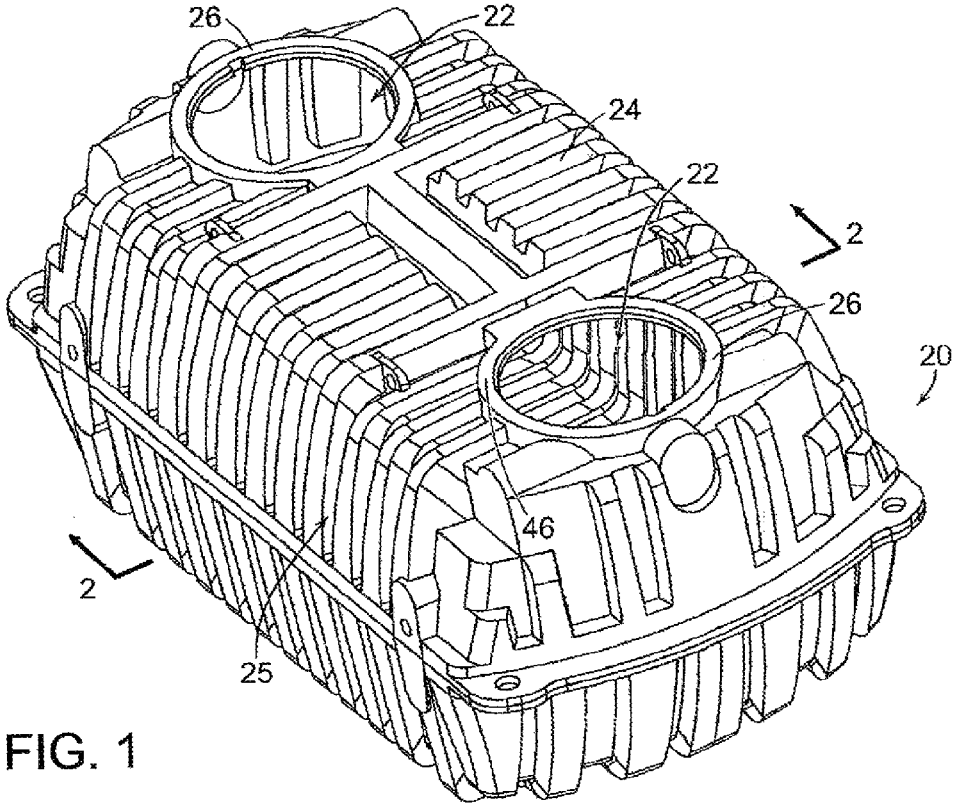
FIG. 1 shows in perspective view the top of a septic tank having two access openings.

FIG. 1 shows a molded thermoplastic septic tank 20 of the type which may have a nominal 1000 gallon working capacity. The construction is in accord with patent application Ser. No. 12/455,774 of Moore et al. now U.S. Pat. No. 8,151,999, mentioned below. Tank 20 and other common tanks have lengths which are greater than both width or height, and they are used in the horizontal position, as pictured in FIG. 1. The tank comprises a body 25 with flanges 26 attached at the peripheries of access openings 22 on the tank top. Flanges 26 are sometimes referred to as adapters or reinforcing rings. Tank body 25 has a generally rectangular transverse cross section, is preferably made of polyethylene, polypropylene or other polyolefin. An exemplary tank may be about 124 inches long, about 66 inches wide and about 51 inches high. The invention may be applied to other sizes, shapes and kinds of tanks and to tanks with different number of top openings including, for instance, tanks having round or oblong or vaguely trapezoidal transverse cross section, round tanks having a single top opening, and so forth. Septic tank sizes for which the invention is useful may have nominal volumes of 375, 900, 1050, 1250 and 1500 U.S. gallons.

As mentioned in the Background, a purpose of access openings is to enable installation of baffles or struts inside the tank at the time of first installation, and to enable maintenance. For such reason, the openings typically have to be large enough for entry of a man or woman, and thus are at least about 18 inches, more typically about 24 inches, in inside diameter. Thus, for the foregoing exemplary tank, such an opening is more than about 20-40 percent of the width of the tank. When the access opening is not round, diameter as used herein shall mean the dimension of a circle which provides an about-equivalent opening area.

Tank 20 can be made by rotational molding and may have the features described in commonly owned patent application Ser. No. 12/455,774 of Moore et al., now U.S. Pat. No. 8,151,999 and patent application Ser. No. 12/455,782 of Kruger et al., now U.S. Pat. No. 8,070,005, both filed on Jun. 5, 2009, the disclosures of which are hereby incorporated by reference. Those features include a composite wall comprised of multiple layers, for instance an outer layer of dense polyethylene, preferably about 0.15 inch thick; a middle layer of foam polyethylene, preferably about 0.5 inch thick; and an inner layer of dense polyethylene, preferably about 0.05 inch thick. In an alternative multi-layer tank, there is only the outer dense layer and an inner foam layer. Such multi-layer wall constructions provide favorable sets of wall properties for a given weight of material per unit area of wall, compared to construction where the wall is all solid material. As will be appreciated, the properties of such multi-layer walls are substantially isotropic in the plane of the wall and anisotropic with respect to the thickness dimension of the wall. Alternatively, a blow molded tank may comprise a first or outer layer and a second or inner layer, with possible further layers, all of essentially the same density. As described in detail below, a flange 26 preferably is made of injection molded fiberglass fiber containing plastic. In contrast the tank, when rotationally molded or blow molded will not have significant fiberglass fiber strengthening, because those processes do not permit such. In the generality of the invention, tank bodies may made by injection molding.

Tank 20 has two access openings 22 which are nominally circular. Flanges 26 are ring flanges and have through-holes or bores 35. Each flange is attached to the body of the tank at the periphery of an opening 22. The bore 35 of a flange is aligned with an access opening 22 of the tank body, so there is a resulting passageway which enables a person or thing to have access to the interior space of the tank from outside the tank. A typical passageway will have a dimension which is greater than 12 inches. The flange 26 in these first-described embodiments is shown in simplified fashion as a flat ring flange with a flat upper surface 46. In the generality of the invention, the flange may have a different shape. For example, it may be horizontally oblong or rectangular; and the flange bottom surface and or top surface may be other than flat.

Figure 2:
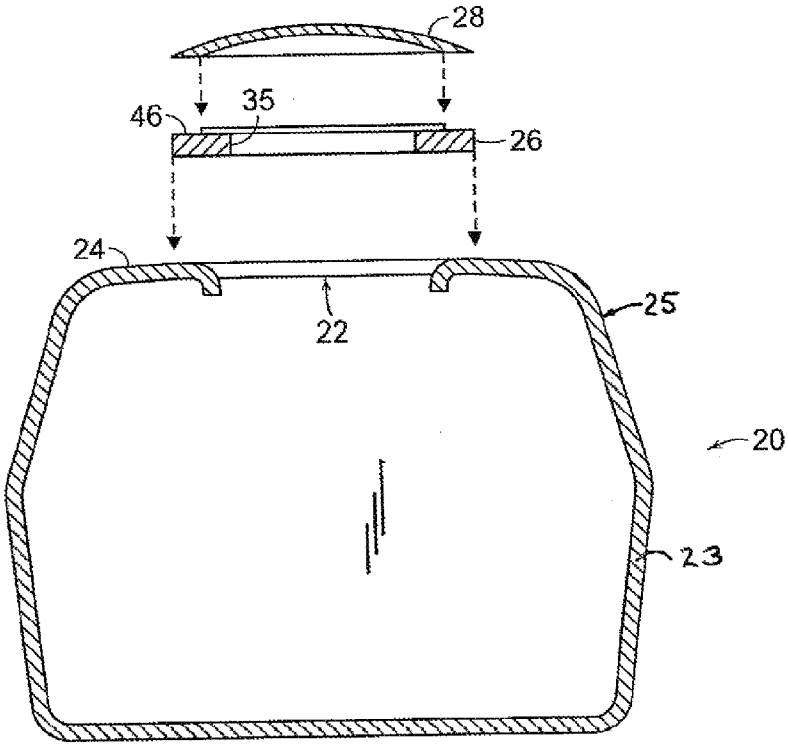
FIG. 2 is a vertical cross section through the tank of FIG. 1, showing in addition, and in exploded view, how a flange and associated lid fit an access opening at the top of the tank.
Figure 3:
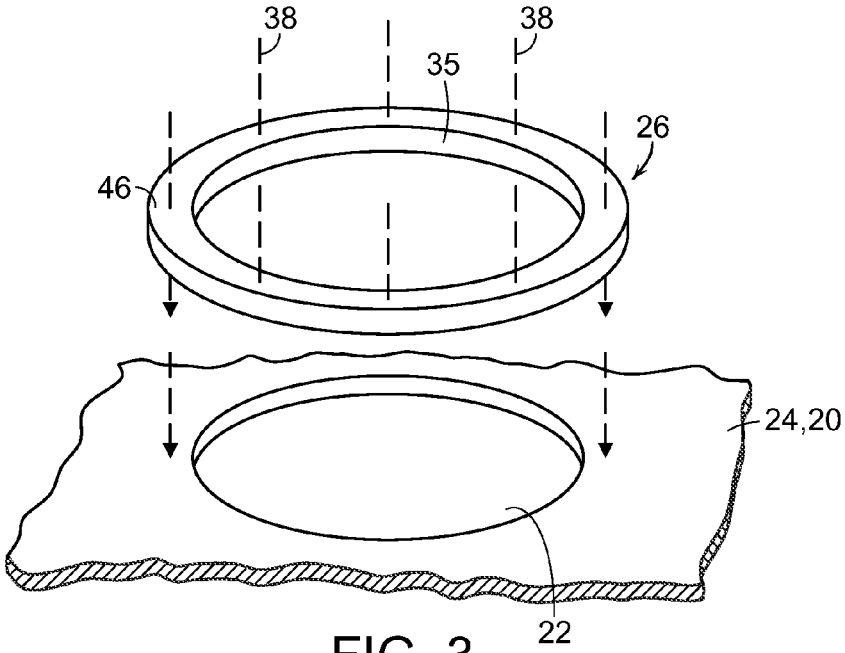
FIG. 3 is a perspective view of a portion of the top of a tank showing how a simplified top flange fits an access opening.

As shown in FIG. 1 and FIG. 2, body 25 contains an interior space that is defined by wall 23 which forms the opposing sides, bottom and top 24 of the tank. In the central part of the tank, the wall runs uninterruptedly around the tank. Wall 23 also forms the integral ends 21F and 21R, also often referred to as end caps. There are two access openings 22 in the top; one is near each end of the tank. Typically, the openings 22 are mechanically cut into the tank body at defined locations after the body is removed from a rotational mold or blow mold. As shown in FIGS. 1, 2 and 3, ring flange 26 is attached to the tank top so the bore 35 of the flange circumscribes opening 22. To fulfill an object of the invention, the flange resists deformation in the horizontal plane of the flange, which deformation is often referred to as "oblong-ing" or "fish-mouthing" of the flange. The flange also resists distortion of the flatness of the top surface 46 (which could be manifested as twisting), or distortion of such other upper surface contour as may characterize the flange.

FIG. 2 is an exploded view which illustrates how a flange 26 is mounted on the top of tank 20 and how a lid 28 fits the top of the flange. The pictured flange is a simplified view of a flange. A more typical flange is detailed in FIGS. 10 to 12. Lid 28 is also simplified for purposes of clarity. A lid typically has radial and circumferential ribs. The lid and flange often may have mating features for inhibiting the intrusion of overlying soil, as may be found in commercially available adapters and risers with lids, for septic tanks. Often the lid will be held in place on the flange by screws or other kinds of removable fasteners, the presence of which is schematically illustrated in various Figures by the vertical broken lines 38.

In achieving objects of invention, the flange has material properties which are significantly different from the material properties of the walls of the tank body. The flange material has greater elastic modulus and greater strength than does the wall material of the tank. For example, a flange is made of a material which has at least 100 percent greater flexural modulus than the material of the tank. Thus, the flange will resist loads transferred to it by means of its connection to the tank, when the tank deforms in response to loads. In the absence of any qualification, a reference herein to the flexural modulus or other strength property of the material which comprises the tank body is a reference to such property as measured in the plane of the wall of the tank. Correspondingly, the flexural modulus or other strength property of the material of the flange is measured in a plane which is parallel to the nominal plane of the surface which is adapted to receive a lid or riser.

A flange may be comprised of a thermoplastic resin which includes 5 to 30 weight percent fibers which are made of glass, alternatively, of other material such as carbon or boron or metal. When short chopped fibers are added to the plastic which is then fabricated into a part, they may in the first instance be characterized as randomly oriented, albeit, a commercial manufacturing process can cause some of the fibers to be non-randomly oriented.

In an example of the invention, 10 weight percent chopped E-glass fibers of about ¼ inch length are incorporated into a polyethylene matrix. Handbook data shows that the flexural modulus of randomly oriented fiber-filled high density polyethylene is increased by about 280, 470 and 636 percent for, respectively, 10, 20, and 30 weight percent, all compared to the same plastic without fibers. Correspondingly, flexural strength is increased by 210, 325 and 410 percent. See Neilsen, L. and Landel, R, "Mechanical Properties of Polymers and Composites" $2^{nd}$ Ed. Marcel Dekker (1994).

In another example, the flange may be made of recycled high density polyethylene containing about 24 weight percent fiberglass fibers, such as StarStran 739M E-glass fibers which are about 12 mm long and 16 micrometer in diameter, available from Johns Manville Co., Denver, Colo., U.S. The material contains about 2 percent coupling agent, such as a Crompton Polybond product available from Chemtura Co. Middlebury, Conn., U.S., along with other minor ingredients such as coloring agents, and optional other additives as may be know in the art.

Any reference herein to the base or to the base composition is a reference to that material which comprises the major ingredient. For instance, polyethylene is the base of each of the foregoing compositions.

A typical fiber which may be used in formulating material for injection molding of a flange will have a diameter be of the order of 10 microns and an aspect ratio (length to diameter ratio) of at least 10:1. It is common that fibers may break into shorter lengths when a fiber and plastic mixture is flowed through injection molding machinery and into a mold.

In preferred embodiments of the invention, the fibers of flange 26 will be at least in significant part nominally aligned in a preferential direction. For example, a significant portion of the fibers is aligned both with the nominal plane of the top of the tank, the nominal top surface of the flange. In another example, the fibers are in significant part aligned with the local tangents to periphery of the flange (and to any concentric bore). A corollary of the just-described alignment of the fibers is that the properties of the flange are anisotropic. The properties are higher in orientations which are useful to resisting forces imposed on the tank during use. A determination of whether a significant portion of fibers are preferentially oriented can be made by microscopic examination of fibers within a specimen using conventional laboratory techniques. A significant portion of aligned fibers is present when the average flexural modulus in the alignment direction (e.g., the tangential direction of a circular ring flange) is at least 15 percent greater than flexural modulus in an orthogonal direction (e.g., the radial direction).

The following are typical properties which characterize a flange made using the foregoing about 24 percent fiberglass and recycled polyethylene material, measured in the plane of the surface of the flange and in a direction which is perpendicular to the local radius: Flexural modulus of at least 200,000 psi, typically 200,000-300,000 psi; and tensile strength of about 5,000 psi. Those properties can be compared to the properties of the above-mentioned 3-layer composite tank wall material, which has a flexural modulus of about 70,000 to 100,000, typically about 85,000 psi.

Thus, from the examples, the material of a flange of the invention will have a flexural modulus which is at least 100 percent, preferably 200 to 300 percent, of the flexural modulus of the material of the associated tank body. Alternatively stated, the flexural modulus of the material of the tank body is less than half the flexural modulus of the material of the flange.

Figure 7:
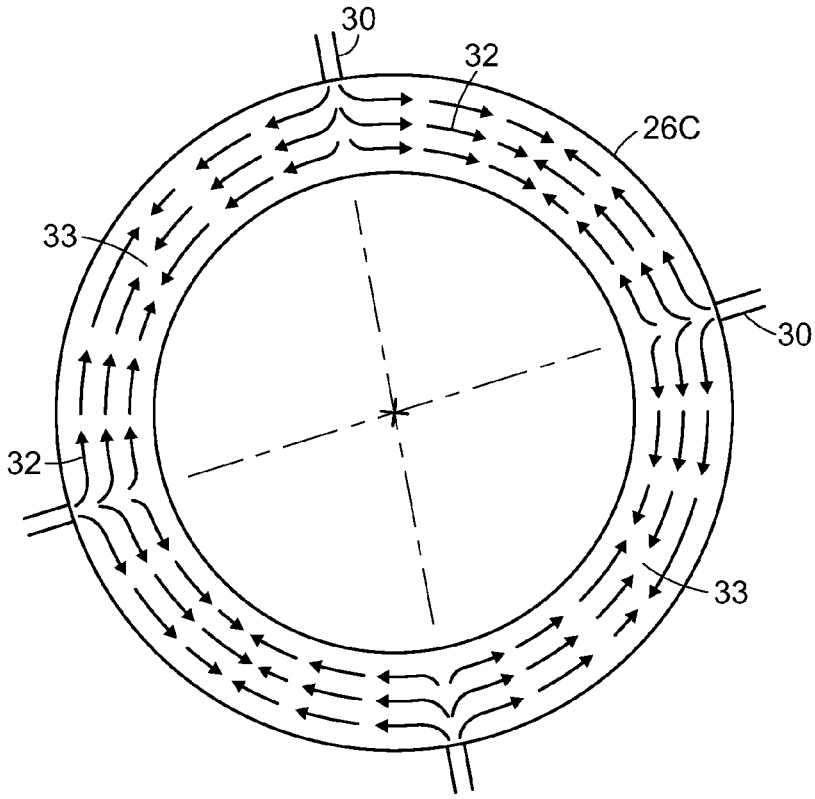
FIG. 7 is a top schematic view of a plastic flange with four radially-inward injection molding nozzles show schematically. Arrows show the direction of plastic flow from the nozzles.
Figure 8:
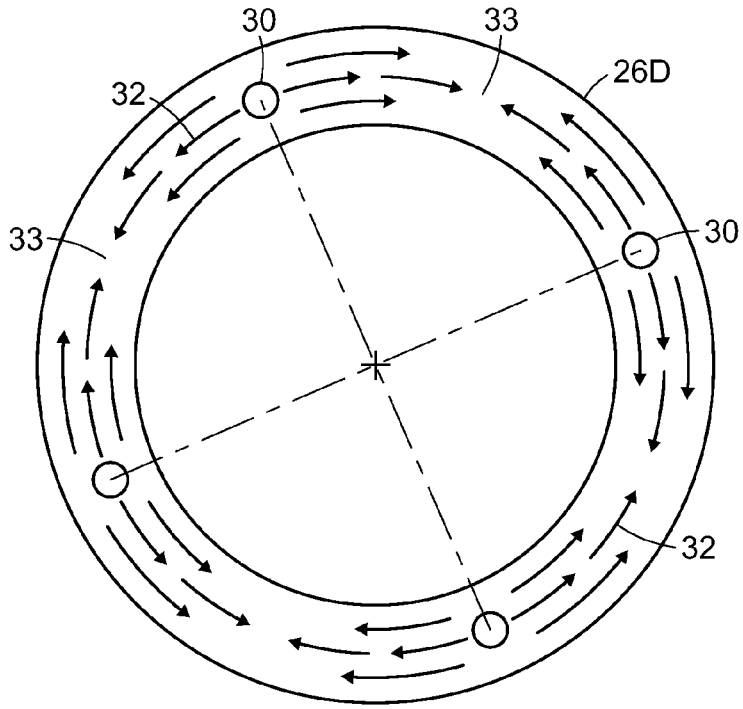
FIG. 8 is a view like FIG. 7, where the four nozzles are perpendicular to the plane of the flange top surface and the plane of the drawing.

In the invention, melted plastic with fiberglass is injected into a mold to form a flange. FIG. 7 and FIG. 8 are schematic representations of ring flanges which are made by injection molding. (The mold is not pictured but may be well-understood and envisioned as providing a core portion which defines the center opening and a cavity portion which defines the outside dimensions of the part.) The multiple arrows 32 show how the plastic flows from the injection port locations 30. Those arrows are also nominally in a plane parallel to the top surface of the flange In FIG. 7 the ports are spaced apart around the periphery of the flange 26C. In FIG. 8 the ports are spaced part around the top or bottom face of the flange. In the generality of the invention, there may be more or lesser number of ports. When plastic containing fibers is passed through an injection molding machine and forced into a mold, a significant portion of the fibers will be oriented in the flow direction of the plastic, that is, nominally in the direction of the arrows in FIGS. 7 and 8.

Thus, properties of plastic material having a fraction of co-aligned fibers are anisotropic, with lesser properties in planes transverse to the fiber alignment direction. There also will be regions 33 of confused fiber orientation, where streams from adjacent ports meet, and those local regions will not have the sought-for superior orientation. While flange properties may not be uniform throughout, as a whole the flange of the invention has properties which are better suited for the application that those which have random fiber orientation. The orientation of fibers which is achieved in an injection molded flange is distinguished from the more uniform alignment of fibers that is associated with pultruded material or sheet molded plastic containing woven mats and the like, from which a flange might be machined.

When planar orientation of the fibers is achieved, i.e., when a significant portion of the fibers is parallel to the top surface of the flange, the flange strength is significantly increased with respect to forces in a plane parallel to the top surface of the flange and the tank body. That means the flange is more resistant to being deformed out of said plane than when the fibers are not significantly aligned.

When the above-described nominal tangential or circumferential orientation of fibers is achieved, there is better strength for resisting deformation in the plane of the flange surface, and better resistance to the "oblong-ing." Thus, the flange will better maintain its roundness or other design shape, resisting transfer of loads which seek to deform the tank body, as described in the Background.

Of course, it is in general undesirable that the tank body deform during use, irrespective of any effect on the shape of an access opening and associated lid or riser. Deforming can result in unwanted localized redistribution of stress and localized premature time-dependent failure. The flanges of the invention, with their high strength and structural attachment to the tank body, help decrease deformation of the tank body, which would otherwise occur, thus better enabling the tank to meet performance requirements.

Since a flange 26 is structurally attached to the tank body, the flange will bear or carry a portion of the stress to which the top is subjected, thus lending strength to the tank body. Structural attachment of the flange to the tank body top may be accomplished by a variety of means which may include separately or in combination: fasteners, such as stainless steel screws; mechanical interlock, such as clamping fingers; welding, using as infra red heating or hot plate welding; and industrial adhesives available from 3M Company, Minneapolis, Minn. and others.

Figure 4:
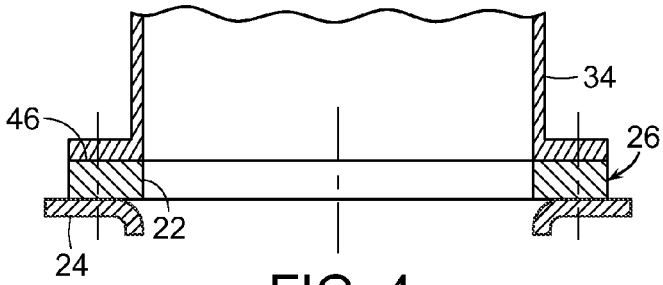
FIG. 4 is a vertical cross section showing a plain flange like that shown in FIG. 3, with a portion of a riser which is mounted on the flange.

A flange top surface may receive articles other than a lid. As shown in the partial vertical cross section of FIG. 4, riser 34, which has a generally hollow-cylinder shape, may mount on the top surface 46 of the flange. A lid can thus be placed on top of the riser, so the lid is nearer to the surface of soil and thus more easily accessed.

Figure 5:
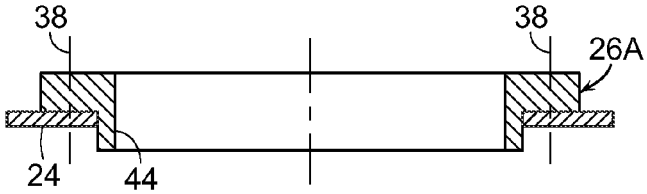
FIG. 5. is a vertical cross section showing a flange having a nipple mounted on the access opening of a tank.
Figure 6:
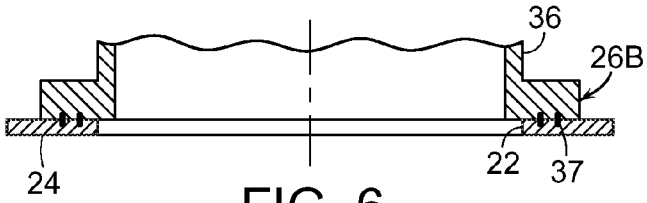
FIG. 6 is a vertical cross section showing a flange which has upwardly portion similar in function to a riser.

As mentioned above, the flange may have different shapes other than the simple flat ring shape of flange 26. With reference to FIG. 5, flange 26A may comprise a downwardly extending nipple portion 44, which extends into the tank 24. With reference to FIG. 6, the flange 26B may comprise an upwardly extending portion 36, which is similar in function to a riser. FIG. 6 also shows how an adhesive or sealant 37 may be used to attach the riser to the flange top surface, usually in combination with mechanical fasteners such as screws.

Figure 9:
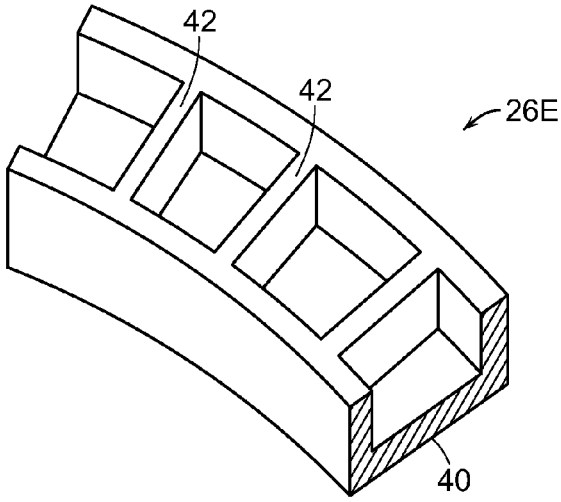
FIG. 9 is a partial view of the bottom side of a ribbed flange.

FIG. 9 shows the bottom side of flange 26E. The flange may comprise a flat top 40 and an underside which comprises radial ribs 42. Different combinations of the foregoing features may be used in flanges of the present invention. In addition, features of flanges known in the art may be employed in carrying out the invention. Examples of different flange shapes are shown in U.S. Pat. No. 6,877,281 of Gavin and Pat. Pub. No. 2006/0081629 of Meyers.

Figure 10:
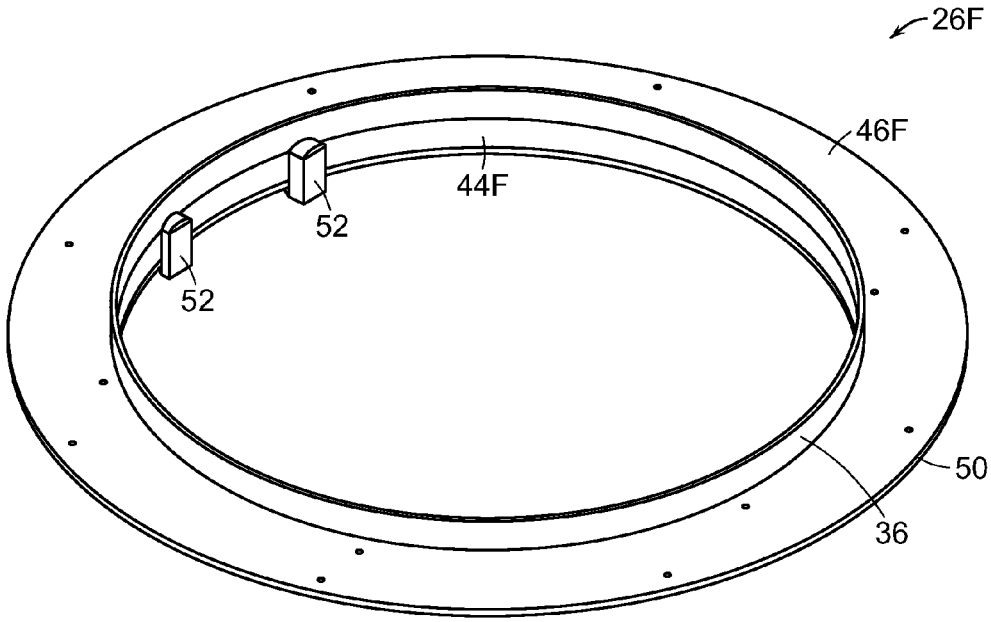
FIG. 10 is an isometric top view of another flange.
Figure 11:
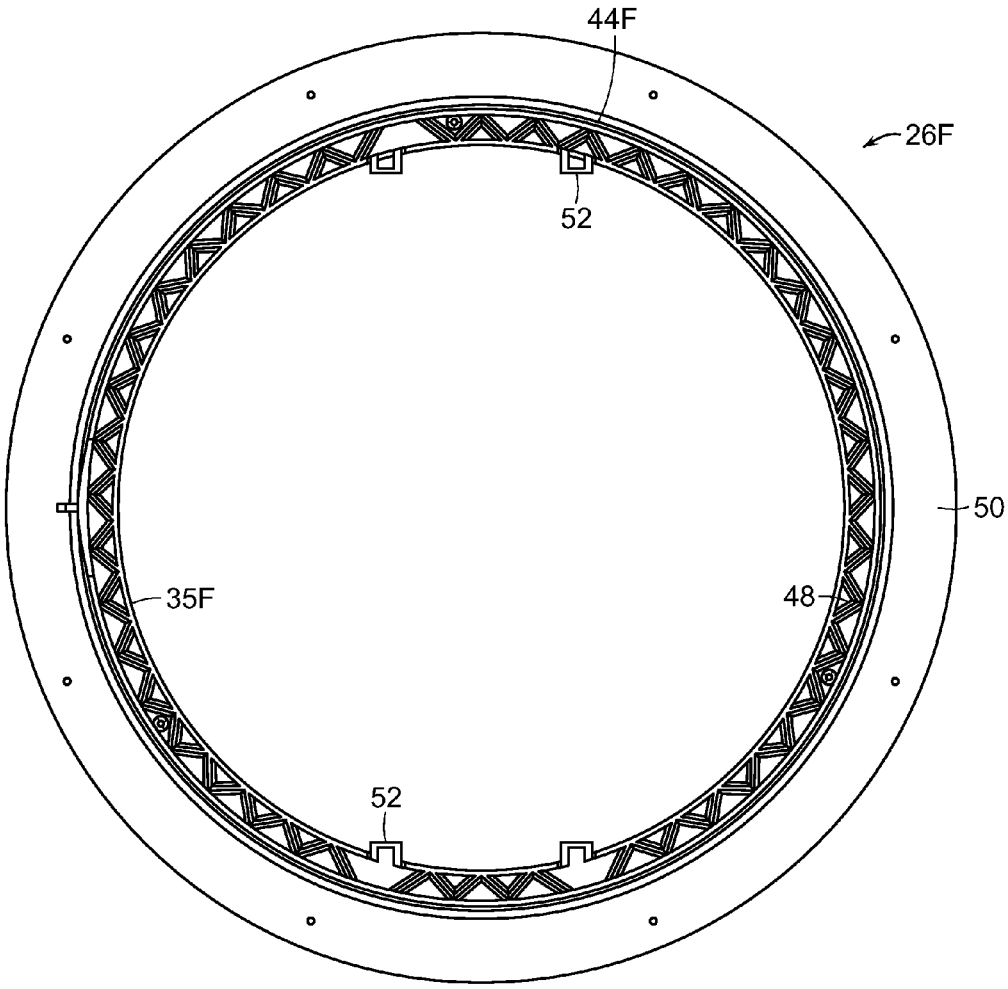
FIG. 11 is a bottom view of the flange of FIG. 10.
Figure 12:
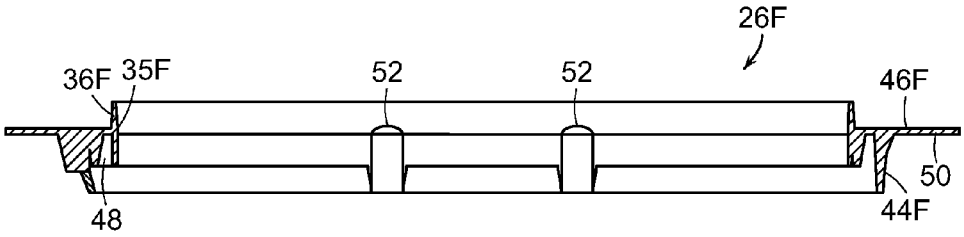
FIG. 12 is a vertical plane cross section of the flange of FIG. 10.

FIG. 10-12 show flange 26F which has several features corresponding to those previously described. The flange has a portion which is a radially extending plate 50 having a surface 46F for receiving a lid or riser, and an associated upwardly-extending sleeve 36F. Both features enable receiving and centering a riser or lid on the flange and thus on the access opening. A downward extending sleeve 44F is strengthened by a zig-zag ribbing running to the underside of plate 50. See FIG. 11. The sleeve 44F centers the flange in the hole of the access opening and also provides rigidity and strength to the flange in both the vertical and horizontal planes. Projections 52 on opposing sides of the bore aid in circumferentially locating, or polarizing, things which might be inserted in the bore of the flange, such as an aeration treatment unit.

A flange in the present invention will desirably be made of a plastic material which has environmental resisting properties consistent with the material of the tank and which is both light and strong. Alternative materials which may be used in the flange, beyond those described above, include the following. For example, flange may be made of a base composition material which is a thermoset material, such as an epoxy resin, with fillers and or fibers. For example, the flange material may be made of a polyester resin base material reinforced with fiberglass mats, or a polycarbonate resin base composition material. Alternately, the flange may be made of any of many engineered plastic materials; for example the flange may be machined from a thermoset plastic containing woven mat of fiberglass or other material.

The present invention, with its variations and features, has advantages which are explicit and implicit. The invention has been described and illustrated with respect to one or more embodiments which should be considered illustrative and not restrictive. Any use of words such as "preferred" and variations thereof are intended to suggest a combination of features which is desirable but not necessarily mandatory; and embodiments lacking any such preferred feature or combination may be within the scope of the claims which follow. Persons skilled in the art may make various changes in form and detail without departing from the spirit and scope of the claimed invention.

We claim:

1. A plastic septic tank for burial in soil wherein the force of surrounding soil tends to deform the tank, comprising:

a blow molded or rotationally molded body comprised of a first plastic material which is free of fibrous reinforcement, the body having a top, at least one access opening in the top having a diameter of at least 12 inches, and an interior space for containing liquid during use; and, at least one injection molded circular flange having an outer periphery and comprised of a second plastic material having fibrous reinforcement, the flange having a bore of at least 12 inches diameter, a bottom, and a top; the top comprising a planar surface portion shaped to receive a septic tank lid or a septic tank riser;

wherein the flange is structurally attached to the top of the body at the location of said at least one access opening so that the combination of flange bore and access opening provides a passageway to the interior space of said body sufficient to enable the installation of a baffle or fitting within said interior space;

wherein the second plastic material comprises 5 to 30 percent by weight of chopped reinforcing fibers which are both randomly oriented and in significant portion aligned with a plane that is nominally parallel to the top of said body and said flange planar surface portion and local tangents to said outer periphery;

wherein said significant portion of fiber alignment provides the material with a flexural modulus in direction parallel to said plane and said local tangents that is at least 15 percent greater than the flexural modulus in a direction orthogonal to said plane; and, wherein the flexural modulus of said second plastic material is at least 100 percent greater than the flexural modulus of the first plastic material.

2. The tank of claim 1 wherein the flange further comprises a sleeve extending downwardly from the bottom of the flange into said access opening without any fitting at the terminal end of the sleeve.

3. The tank of claim 1 wherein the flexural modulus of the second plastic material is at least 200,000 psi.

4. The tank of claim 1 wherein the base composition of the second plastic material is the same as the base composition of the first plastic material.

5. The tank of claim 1 wherein the second plastic material and first plastic material have base compositions which are different.

6. The tank of claim 1 wherein the first plastic material is comprised of thermoplastic resin and the second plastic material is comprised of thermoset resin.

7. The tank of claim 1 wherein the first plastic material has a base composition which is either polyethylene or polypropylene and the second plastic material has a base composition which is either polyethylene or polypropylene.

8. The tank of claim 1 wherein the first plastic material is polyethylene and comprises an outer dense layer, a middle foam layer, and an inner dense layer.

* * * * *